United States Patent [19]

Suzuki et al.

[11] Patent Number: 4,732,550

[45] Date of Patent: Mar. 22, 1988

[54] SCROLL FLUID MACHINE WITH FINE REGULATION ELEMENTS IN GROOVES HAVING STEPPED PORTION

[75] Inventors: Yasuyuki Suzuki; Toshiyuki Nakamura; Takahiro Maeda, all of Wakayama, Japan

[73] Assignee: Mitsubishi Denki Kabushiki Kaisha, Tokyo, Japan

[21] Appl. No.: 927,220

[22] Filed: Nov. 5, 1986

[30] Foreign Application Priority Data

Nov. 27, 1985 [JP] Japan ..... 60-268438

[51] Int. Cl.[4] ..... F01C 1/04; F01C 19/08; F16J 15/16

[52] U.S. Cl. ..... 418/55; 418/57; 418/142; 277/168; 277/170; 277/204

[58] Field of Search ..... 418/55, 57, 142; 277/168, 170–172, 204, 81 R

[56] References Cited

U.S. PATENT DOCUMENTS

| | | | |
|---|---|---|---|
| 2,462,596 | 2/1949 | Bent | 277/168 |
| 3,347,555 | 10/1967 | Norton | 277/171 |
| 3,994,636 | 11/1976 | McCullough et al. | 418/55 |
| 4,415,317 | 11/1983 | Butterworth | 418/55 |
| 4,462,771 | 7/1984 | Teegarden | 418/55 |
| 4,655,697 | 4/1987 | Nakamura et al. | 418/57 |

FOREIGN PATENT DOCUMENTS

| | | |
|---|---|---|
| 0012614 | 6/1980 | European Pat. Off. . |
| 165714 | 12/1985 | European Pat. Off. . |
| 5574643 | 5/1982 | Japan . |
| 2092675 | 8/1982 | United Kingdom . |
| 2108201 | 5/1983 | United Kingdom . |

*Primary Examiner*—John J. Vrablik

*Attorney, Agent, or Firm*—Burns, Doane, Swecker & Mathis

[57] ABSTRACT

The present invention relates to a scroll fluid machine in use for compressors, expanders and the like, comprising spiral fine regulation elements having the same curvature as each spiral side plate of a fixed scroll and an orbiting scroll and grooves provided in an end face of each spiral side plate of both scrolls and provided with a stepped portion formed halfway thereof for being forced thereinto said spiral fine regulation elements, and axial gap between the end face of each spiral side plate of the fixed scroll and the orbiting scroll and the opposite bottom face of each bed plate being finely regulated by setting depths of putting the fine regulation elements in the grooves, whereby preventing a fluid from leaking in the operation thereof.

19 Claims, 22 Drawing Figures

SCROLL FLUID MACHINE WITH FINE REGULATION ELEMENTS IN GROOVES HAVING STEPPED PORTION

BACKGROUND OF THE INVENTION

1. Field of the Invention

This invention relates to a scroll fluid machine used for compressors, such as air compressors and refrigerant compressors, pumps, expanders or the like, in particular to a gap-fine regulation mechanism of a scroll fluid machine.

2. Description of the Prior Art

The principle of a scroll fluid machine has been known for a long time and its application to various kinds of machine, such as compressors, pumps and expanders, has been thought of. Referring now to FIG. 1 which shows fundamental constituent elements of a scroll fluid machine, reference numeral 1 designates a fixed scroll, 2 designating an orbiting scroll, 1*a* designating a discharge port, P designating a compression chamber, O designating a fixed point of the fixed scroll 1, and O′ designating a fixed point of the orbiting scroll 2. The fixed scroll 1 and the orbiting scroll 2 are provided with a pair of spiral side plates 101, 201, whose winding directions are opposite to each other and whose shapes are the same, being formed on bed plates (not shown) thereof, and being joined together as shown in FIG. 1, and said spiral side plates 101, 201 being brought into contact with each other on axial sides thereof at a plurality of points B at which said spiral side plate 101 is brought into contact with said spiral side plate 201. The spiral side plates 101, 201 have a shape of involute curve.

Next, the operation of the scroll fluid machine when operated as a compressor is described. Referring to FIG. 1, the fixed scroll 1 is stationary relatively to the space, the orbiting scroll 2 is stationary relatively to the space, the orbiting scroll 2 being joined with the fixed scroll 1 as shown in FIG. 1, and the orbiting scroll 2 carrying out a rotational motion without changing an attitude thereof relative to the space, in short carrying out a revolution without rotating on its own axis and with making a spiral center thereof eccentric to move by 0°, 90°, 180° and 270° as shown in FIG. 1. Said points B move toward the center with the movement of the orbiting scroll 2, a volume of the crescent-shaped compression chamber P defined by the spiral side plate 101 of the fixed scroll 1, the spiral side plate 201 of the orbiting scroll 2 and both spiral side plates 101, 201 being gradually reduced, and a gas introduced into the compression chamber P being compressed to be discharged through the discharge port 1a formed at the center in the radial direction of the fixed scroll 1. A distance from the point O to the point O′ as shown in FIG. 1 is maintained constant during that period and provided that a thickness of both spiral side plates 101, 201 is t and a gap between both spiral side plates 101, 201 is z, $OO'=z/2-t$ holds good.

In addition, if the orbiting scroll 2 is rotated in the opposite direction, in short by 0°, 270°, 180° and 90° as shown in FIG. 1, this scroll fluid machine operates as an expander.

The concrete construction of a scroll fluid machine operated on the basis of such an operation principle is described with reference to FIG. 2. Referring to FIG. 2, which is a sectional view showing the main parts of the conventional scroll fluid machine in the case where it is applied as a compression machine, reference numeral 1 designates a fixed scroll, 2 designating an orbiting scroll, 1*a* designating a discharge port, and P designating a compression chamber, similarly to FIG. 1. The fixed scroll 1 and the orbiting scroll 2 comprises a spiral side plate 101, 201 and a bed plate 102, 202, respectively. In addition, the orbiting scroll 2 is combined with the fixed scroll 1 under the condition that a surface opposite to a surface, where the spiral side plate 201 is formed, of the bed plate 202 is supported by a frame 4 as shown in FIG. 1 while the fixed scroll 1 is fixedly mounted on the frame 4. Further, A in the figure designates an axial gap between end faces 101*a*, 201*a* of the spiral side plates 101, 201 and bottom faces 202*a*, 102*a* of the bed plates 202, 102 facing to the spiral side plates 101, 201, respectively.

And, when a main shaft 3 connected to the orbiting scroll 2 is rotated as shown by an arrow, the orbiting scroll 2 carries out only a revolution without rotating on its own axis by means of an auto-rotation preventing device (not shown). As a result, a fluid to be compressed is sucked in through a suction port 1*b* formed on an outside end portion of the fixed scroll 1, compressed on the basis of the operation principle shown in FIG. 1, and exhausted through the discharge port 1*a*.

In such a fluid machine, since a fluid flowing in the radial direction of spiral through said gap A shows a leakage-line length corresponding to a peripheral length of spiral, it is relatively large compared to a volume of a fluid to be sucked in and its influence upon an efficiency of the machine is great.

A means, in which the gap A is made minute, an oil being sucked in together with a fluid to be compressed through the suction port 1*b*, and an oil film being formed in the minute gap A to prevent the fluid to be compressed from leaking, has been proposed for such a method of sealing in the radial direction, as shown in Japanese Patent Application Laid-Open No. 46081/1980.

However, problems have occurred in that the formation of such minute gaps uniformly requires a high dimensional accuracy for parts, such as the fixed scroll 1, the orbiting scroll 2 and the frame 4, and parts matching to each other in size must be selected in the assembly of such parts. Besides, the vicinity of the discharge port 1a is heated to high temperatures by the compressed fluid during the operation and as a result, when a thermal expansion of the spiral side plates exceed the minute gap A, the sticking is produced as there is not relief space. Accordingly, the thermal expansion of the spiral side plates must be assumed to previously increase the minute gap A so much as that. However, is so, the gap A exceeds the optimum gap required for the formation of the effective oil film and as a result the leakage is increased, whereby losing the sealing effect in many cases.

On the other hand, also a method, in which the end faces 101*a*, 201*a* of the spiral side plates 101, 201 are provided with a groove formed along the longitudinal direction of spirals and sealing material is inserted in this groove to prevent the leakage in a contact-sealing manner differently from the above described method of preventing the leakage by the formation of the oil film, has been thought of. Such a sealing method is formerly disclosed in U.S. Pat., No. 801,182, 1905 and recently in Japanese Patent Application Laid-Open No. 117304/1976.

Next, the preventing method disclosed in Japanese Patent Application Laid-Open No. 117304/1976 is described as one example with reference to FIGS. 3-5. Referring to FIG. 3, which is a partial sectional view showing a vicinity of the gap A between the bottom face 102*a* of the bed plate of the fixed scroll 1 and the end face 201*a* of the spiral side plate of the orbiting scroll 2, the end face 201*a* of the spiral side plate 201 is provided with a groove 5 opening along the longitudinal direction of spirals and having a rectangular cross section formed therein, a sealing material 51 having the same shape as the groove 5 being inserted in the groove 5. Here, the groove 5 and the sealing material 51 are prescribed in size so that an upper surface 51*a* of the sealing material 51 may be brought into contact with the bottom face 102*a* of the bed plate, a side face 51*c* of the sealing material 51 may be brought into contact with a side face 5*c* of the groove 5, a gap 501 may be formed in the longitudinal direction of spirals between a side face 5*b* of the groove 5 and a side face 51*b* of the sealing material 51, and a gap 502 may be formed similarly in the longitudinal direction of spirals between a bottom face 5*d* of the groove 5 and a lower surface 51*d* of the sealing material 51. And, as a result, even when the gap A exists between the end face 201*a* of the spiral side plate 201 and the bottom face 102*a* of the bed plate, the sealing between a high-pressure side compression chamber $P_H$ and a low-pressure side compression chamber $P_L$ partitioned by the spiral side plate 201 is performed by making the fluid flow into the gaps 401, 502 from the high-pressure side compression chamber $P_H$ as shown by a full arrow so that a force may act in a manner as shown by an arrow F. In short, the upper face 51*a* and the side face 51*c* of the sealing material 51 is pressed against the bottom face 102*a* of the bed plate and the side face 5*c* of the groove 5, respectively, the sealing material 51 is closely adhered to the bottom face 102*a* of the bed plate and the side face 5*c* of the groove 5 to prevent the fluid from leaking.

In a sealing method of this type, although the leakage of the fluid in the radial direction of spirals through the gap A between the end face of the spiral side plate and the bottom face of the bed plate can be effectively prevented, a problem has occurred in that the leakage is apt to occur in the longitudinal direction of spirals through the gaps 501, 502 between the compression chambers P partitioned by the spiral side plates 101, 201 at the points B.

This leakage is described in FIGS. 4, 5, in which FIG. 4 is a partial sectional view as seen from the upper face, showing the vicinity of the points of contact B where the spiral side plate 101 is brought into contact with the spiral side plate 201, and FIG. 5 is a partially sectioned perspective view showing the vicinity of the points of contact B as shown in FIG. 4.

These figures show the state in which the fluid is leaked from the high-pressure side compression chamber P to the low-pressure side compression chamber P through the gaps 501, 502 as shown by a full arrow. As above described, the sealing method of this type can effectively perform the sealing in the radial direction but since the gaps 501, 502 must be formed between the groove 5 and the sealing material 51 as the means for effectively sealing in the radial direction, it is inevitable that the leakage is produced in the longitudinal direction of spirals and a compression efficiency, in short a performance, is reduced. In particular, there is the possibility that the fluctuation of the gaps 501, 502 in size due to the machining accuracy leads to an increase of the leakage through the gaps 501, 502 or an increase of the leakage in the radial direction due to a reduction of the sealing material 51 in followability itself. In addition, since the upper face 51*a* of the sealing material 51 slides by being pressed against the bottom face 102*a* of the bed plate by the action of the fluid, also the sliding loss and abrasion can not be disregarded.

Besides, in order to prevent such a leakage in the longitudinal direction of spirals, for example in Japanese Utility Model Application Laid-Open No. 180181/1982, a width size D of the sealing material 51 is substantially equalized to that D' of the groove 5, and a thickness size H of the sealing material 51 is larger than a depth size H' of the groove 5, as shown in FIG. 6. However, in this method, the sizes H and H' are difficult to control and if $H-H'<A$, an axial gap is opened to produce the leakage in the radial direction of spirals while if $H-H'>A$, the sealing material 51 is to be put between the fixed scroll 1 and the orbiting scroll 2, whereby the smooth rotation is hindered.

As described above, the conventional scroll fluid machine has a problem in the accuracy control such as the machining accuracy required for making an axial minute gap uniformly in a method of forming an oil film. In addition, the conventional scroll fluid machine has shown the contradictory problems in that if the gap is made small, the end face of the spiral side plate is brought into contact with the opposite bed plate due to a thermal expansion in the operation and the like to produce the sticking, whereby lowering the reliability while if the gap is made large in order to prevent the above described problem, the performance is remarkably reduced. Besides, in a contact-sealing method, in the case where the gap is formed between the sealing material and the groove to followablly close by a pressure of a fluid, the problem occurs in the reduction of the performance due to the leakage through said gap and the abrasion of the sealing material. Furthermore, the case, where the gap is not formed between the sealing material and the groove and the sealing is carried out by means of sealing materials, has a problem in that the strict accuracy control is required similarly to the oil-film forming type method.

SUMMARY OF THE INVENTION

The present invention was achieved in view of the above described state.

Thus, it is a first object of the present invention to provide a highly efficient and reliable scroll fluid machine, in which the fine regulation of an axial gap, defined by an end face of a spiral side plate of a fixed scroll, an end face of a spiral side plate of an orbiting scroll, a bottom face of a bed plate of the fixed scroll and a bottom face of a bed plate of the orbiting scroll, can be carried out through a fine-regulation element having the same spiral shape as each spiral side plate of the fixed scroll and the orbiting scroll, the fluctuation of the fixed scroll, the orbiting scroll and the like in machining accuracy being eliminated, there being substantially no gap or the gap being able to be adjusted to a necessary but minimum minute one, and the leakage during the operation being able to be effectively prevented by forcing said line-regulation element into a groove, which is formed as a contact seal along the end face of the spiral side plates of both scrolls and provided with a stepped portion formed halfway in the direction of a depth thereof.

It is a second object of the present invention to provide a scroll fluid machine, in which the movement of the fine-regulation element downward in the axial direction due to the fluctuation of a pressure in a chamber, in which the scroll fluid machine is being operated, can be prevented by forming a width of the groove at an opened portion above the stepped portion to be larger than that of the bottom portion below the stepped portion in width, whereby the fine-regulation element can be fixed under the stabilized condition without being sunk into the groove and as a result, the scroll fluid machine can be stably operated.

It is a third object of the present invention to provide a scroll fluid machine, in which the fine-regulation element is fixed under the condition that both side faces thereof are adhered to the side face below the stepped portion of the groove by selecting the fine-regulation element so as to be larger than the groove at the bottom portion below the stepped portion of the groove in width and smaller than the groove at the opened portion above the stepped portion in width, whereby the scroll fluid machine can be stably operated.

It is a fourth object of the present invention to provide a scroll fluid machine, in which the fine-regulation element can be easily forced into the groove below the stepped portion due to a tapered shape for the stepped portion formed in the groove so as to reduce the width of the groove downward.

It is a fifth object of the present invention to provide a scroll fluid machine, in which the fine-regulation element is formed of flexible materials, whereby the fine-regulation element can be easily forced into the groove having a width smaller than that thereof below the stepped portion.

It is a sixth object of the present invention to provide a scroll fluid machine, in which a height size of the fine-regulation element is selected so as to be substantially equal to or smaller than a depth size of the groove, whereby distances of axial gaps between each end face of the spiral slide plates and each end face of the bed plates of the fixed scroll and the orbiting scroll can be adjusted to the preset value and as a result, the scroll fluid machine can be stably operated.

The above and further objects and features of the invention will more fully be apparent from the following detailed description with accompanying drawings.

DESCRIPTION OF THE PREFERRED EMBODIMENTS

Figure 7:
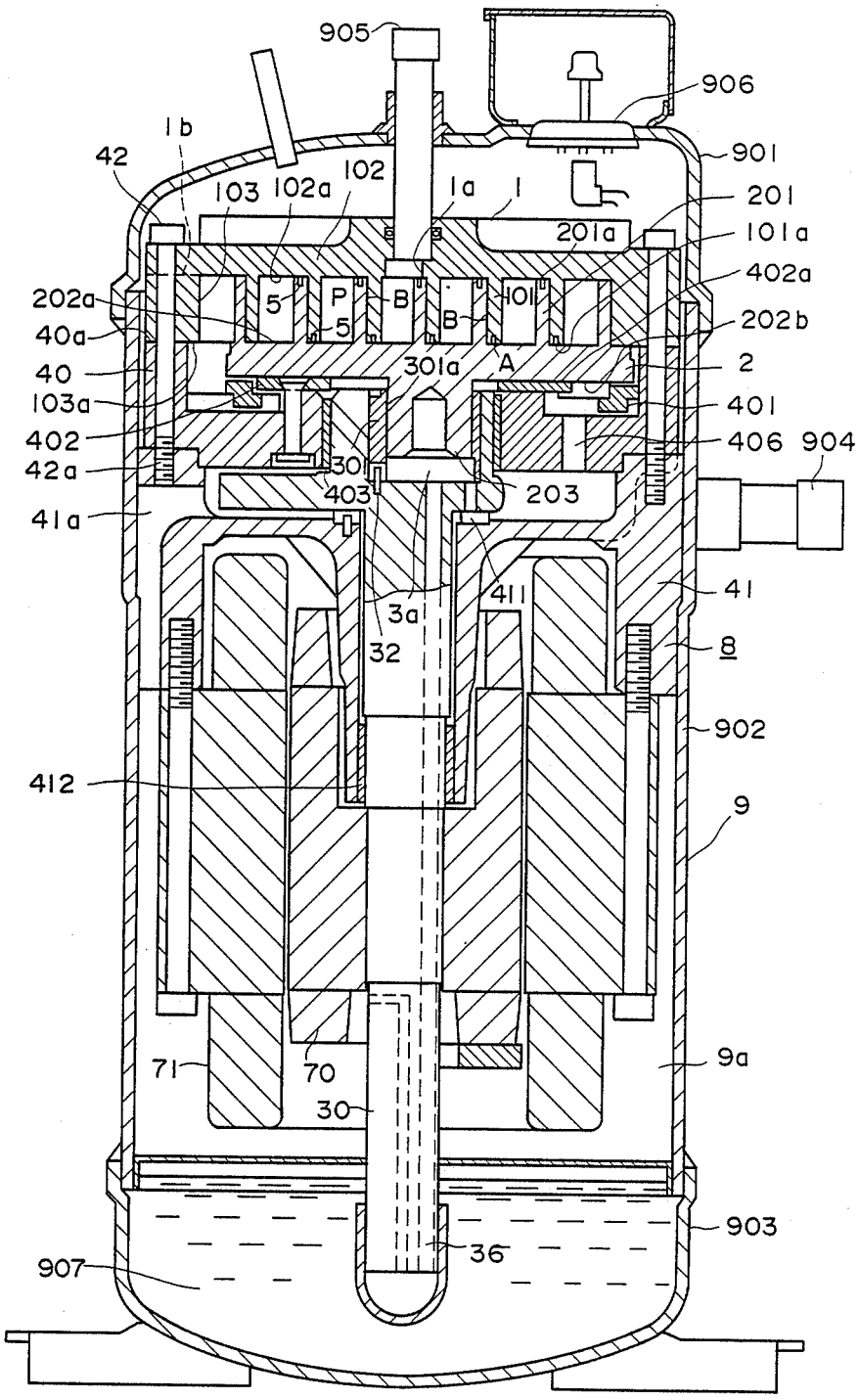
FIG. 7 is a sectional view showing a scroll fluid machine according to the present invention applied to a scroll compressor.

The preferred embodiments of the present invention are described below with reference to the drawings. Referring now to FIG. 7, reference numeral 1 designates a fixed scroll, 2 designating an orbiting scroll, the fixed scroll 1 being provided with a discharge port 1*a* formed in the central portion thereof, and the fixed scroll 1 being provided with a suction port 1*b* formed in a circumferential wall 103 thereof. In addition, the fixed scroll 1 comprises a disk-shaped bed plate 102 and a spiral side plate 101 integrally formed with the bed plate 102 while the orbiting scroll 2 comprises a disk-shaped bed plate 202 and a spiral side plate 201 integrally formed with the bed plate 202 similarly to the fixed scroll 1, both scrolls 1, 2 being engaged with each other to form a compression chamber P surrounded by the bed plates 102, 202 and the spiral side plates 101, 201. Of a plurality of formed compression chamber P, the central compression chamber having the highest pressure communicates with the discharge port 1*a*.

Said spiral side plate 101, 201 is provided with a groove 5, 5 as a guide member formed along the longitudinal direction of spirals except for the inner end portion and outer end portions in the spiral direction on each of end faces 101*a*, 201*a* thereof, a fine-regulation element (hereinafter merely referred to as an element) 6, 6 being put in each of the grooves 5, 5, respectively. Said elements 6, 6 are forced into the grooves 5, 5 so that a part of both side faces thereof may be completely adhered to the inside face of the grooves 5, 5 in the longitudinal direction of spirals.

The bed plate 202 of the orbiting scroll 2 is provided with an axis 203 vertical to a back face 202*b* of the bed plate 202 and parallel to a main shaft 3, which will be described later, for rotating the orbiting scroll 2 at the central portion of the back face 202*b* thereof. In addition, the main shaft 3 is provided with an eccentric hole 3*a* having an axis shaft line parallel to an axis shaft line (a center of rotation) thereof formed on the upper end face thereof. An almost cylindrical eccentric bush 301 is rotatably put in the eccentric hole 3*a* for imparting a pressing force to the orbiting scroll 2 so that even when the spiral side plates 101, 201 are worn, the side faces of both side plates 101, 201 may be brought into contact with each other always at a portion B. Said eccentric bush 301 is eccentric relative to an outside circumference thereof, an axis shaft line thereof being provided with an eccentric hole 301*a* parallel to an axis shaft line of the main shaft 3, said axis 203 being rotatably inserted in this eccentric hole 301*a*.

The main shaft 3 is supported by an upper frame 40 having an almost same outside circumferential surface shape as the fixed scroll 1 and a same largest outside diameter as the fixed scroll 1, an upper main shaft bearing 403 mounted on the upper frame 40 for receiving a radial load of the main shaft 3 at the upper portion thereof, a lower frame 41 having an almost same outside circumferential surface shape as the fixed scroll 1 and a largest outside diameter larger than that of the fixed scroll 1, a lower ring thrust bearing 411 for receiving a weight of the main shaft 3 of its own and other thrust loads given to the main shaft 3, and a lower main shaft bearing 412 for receiving a radial load of the main shaft 3 at the lower portion thereof. The upper frame 40 and the lower frame 41 are combined with each other by means of a faucet joint and the like so that the upper main shaft bearing 403 and the lower main shaft bearing 412 may be concentric with each other.

In addition, since the upper ring thrust bearing 402 for receiving the pressure within the compression chamber P and a weight of the orbiting scroll 2 of its own is concentric with said upper main shaft bearing 403 and an axis shaft line of the upper main shaft bearing 403 is vertical to a bearing surface 402*a* of the upper thrust bearing 402, the axis shaft line of the main shaft 3 is maintained so as to be concentric with an axis shaft line of the upper thrust bearing 402 and vertical to the bearing surface 402*a* of the upper thrust bearing 402. Besides, since the orbiting scroll 2 is supported by the bearing surface 402*a* of the upper thrust bearing 402 at the back face 202*b* of the bed plate 202 thereof, the bed plate 202 of the orbiting scroll 2 is maintained so as to be vertical to the main shaft 3.

An Oldham's coupling is arranged between the bed plate 202 of the orbiting scroll 2 and the upper frame 40 as a coupling means for preventing the orbiting scroll 2 from rotating on its own axis and making the orbiting scroll 2 revolve around the axis shaft line of the main shaft 3.

Figure 8:
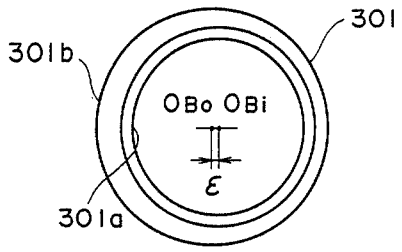
FIGS. 8, 9, 10 are diagrams showing an eccentric bush.
Figure 9:
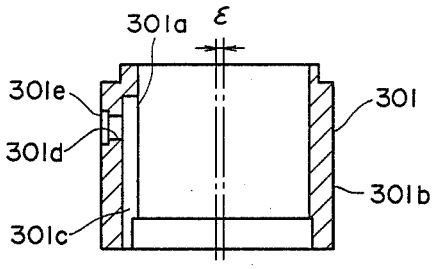
Figure 10:
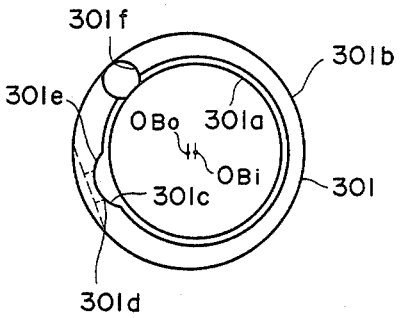

FIGS. 8 to 10 show in detail the construction of the eccentric bush 301 to be inserted in the eccentric hole 3*a* of the main shaft 3, in which FIG. 8 is a top view, FIG. 9 being a side sectional views, and FIG. 10 being a bottom view. Referring to these figures, 301*a* designates an inside circumferential surface of the eccentric bush 301, 301*b* designating an outside circumferential surface of the eccentric bush 301, $O_{Bi}$ designating a center of the inside circumferential surface 301*a* of the eccentric bush 301, and $O_{Bo}$ designating a center of the outside circumferential surface 301*b* of the eccentric bush 301, the center $O_{Bi}$ being eccentric relatively to the center $O_{Bo}$ by $\epsilon$.

An oil groove 301*c* is formed in the longitudinal direction of the inside circumferential surface 301*a* of the eccentric bush 301, under the condition that is lower end is opened into the lower end face of the eccentric bush 301 and its upper end face is closed not so as to be opened into the upper end face of the eccentric bush 301, the radial outer end of an oil hole 301*d* for communicating said oil groove 301*c* with the outside circumferential surface 301*b* of the eccentric bush 301 being opened into a notched portion 301*e* formed in the outside circumferential surface 301*b* of the eccentric bush 301. In addition, a thick-walled portion of the eccentric bush 301 is provided with a rotation-preventing hole 301*f* formed on the lower end face thereof. Furthermore, the eccentric bush 301 is made of bearing metals such as aluminum alloys, lead and bronze.

Figure 11:
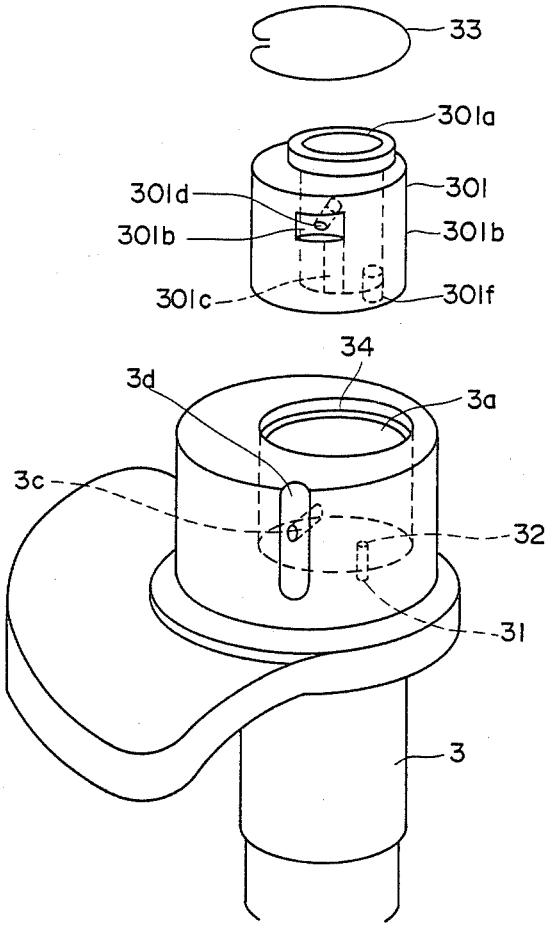
FIG. 11 is perspective view showing a state of mounting the eccentric bush on a main shaft.

Referring to FIG. 11 which is a perspective view showing an assembly procedure of mounting the eccentric bush 301 on the main shaft 3, at first an almost cylindrical spring pin 32 having a C-shaped section is inserted into a pin hole 31 formed on a bottom portion of the eccentric hole 3*a* of the main shaft 3 and then the eccentric bush 301 is inserted into the eccentric hole 3*a* so that the rotation-preventing hole 301*f* formed on the lower portion of the eccentric bush may fit this spring pin 32. A snap ring 33 is put into a snap-ring groove 34 formed in the circumferential direction of a side surface of the eccentric hole 3*a* under the condition that the spring pin 32 is inserted into the rotation-preventing hole 301*f* and the lower end face of the eccentric bush 301 is engaged with the bottom surface of the eccentric hole 3*a*. The snap ring 33 is obtained by forming elastic materials, such as a thin piano wire, into a C-letter shape.

Figure 12:
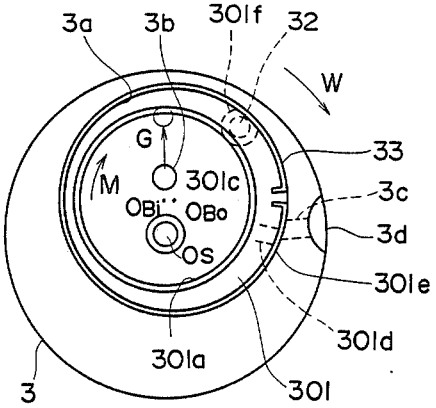
FIG. 12 is a diagram showing a state of the eccentric bush incorporated in the main shaft.

Referring to FIG. 12 which shows a state of the eccentric bush 301 being incorporated in the main shaft 3, $O_s$ designates an axis shaft line, in short, a center of rotation, of the main shaft 3, the position of the spring pin 32 being determined so that a straight line formed by said center $O_s$ and said center $O_{Bi}$ of the inside circumferential surface 301*a* of the eccentric bush 301 may meet at almost right angles with a straight line formed by said center $O_{Bi}$ and the center $O_{Bo}$ of the outside circumferential surface 301*b* of the eccentric bush 301. A diameter of the rotation-preventing hole 301*f* is larger than that of the spring pin 32, the eccentric bush 301 being adapted to be movable to some degree in the circumferential direction. Besides, the notched portion 301*e* is formed in the circumferential direction by an appointed length so that the oil hole 301*d* of the eccentric bush 301 may always communicate with the oil hole 3*c* formed in the radial direction of a large-diameter portion of the main shaft 3. Said oil hole 3*c* communicates also with the oil groove 3*d* formed in the axial direction of the outside circumferential surface of the large-diameter portion of the main shaft 3.

After said constituent parts are assembled in the above described relative positions, the elements 6, 6 are forced into the grooves 5, 5 of the fixed scroll 1 and the orbiting scroll 2 so as to largely project from the grooves 5, 5, the upper frame 40, the lower frame 41 and the fixed scroll 1 being fastened together by means of a plurality of bolts 42 which pass through the circumferential wall protion 103 of the fixed scroll 1 and the upper frame 40 and of which top screw portion 42*a* is screwed only in the lower frame 41. This state is shown in FIG. 13.

Figure 13:
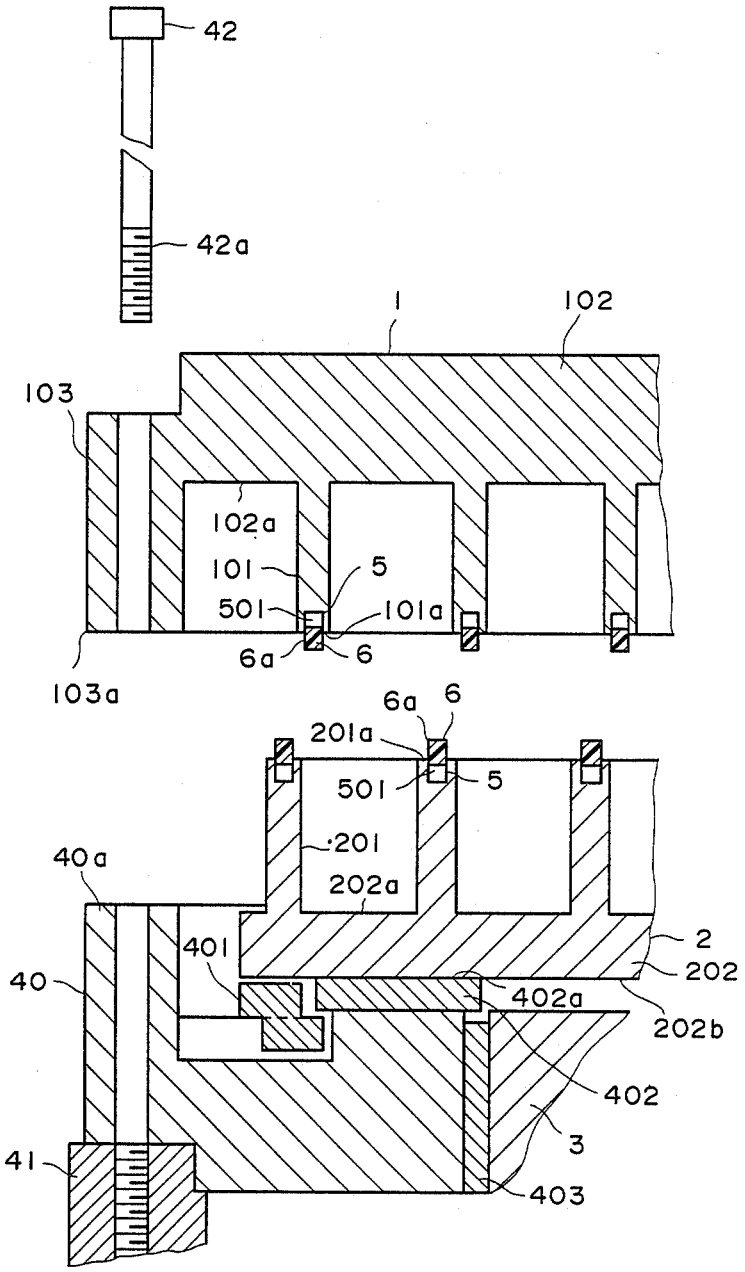
FIG. 13 is a sectional view showing an assembled state of FIG. 7.

Referring to FIG. 13, since, the fixed scroll 1 is fixedly mounted on a fitting surface 40*a* formed on the upper face of the outside circumferential portion of the upper frame 40 on the lower face 103*a* of the circumferential wall portion 103 but the fitting surface 40*a* of the upper frame 40 is parallel to a bearing surface 402*a* of the upper thrust bearing 402, the back face 202*b* of the bed plate 202 of the orbiting scroll 2, the bottom face 202*a* opposite to the back face 202*b* and the end face 201*a* of the spiral side plate 201 being parallel to each other, the lower face 103*a* of the circumferential wall portion of the fixed scroll 1 and the end face 101*a* of the spiral side plate 101 being on the same one plane, and said end face 101*a* being parallel to the bottom face 102*a* of the bed plate 102, the end face 101*a* of the spiral plate of the fixed scroll 1 is maintained so as to be parallel to the bottom face 202*a* of the bed plate of the orbiting scroll 2 while the end face 201*a* of the spiral side plate of the orbiting scroll 2 is maintained so as to be parallel to the bottom face 102*a* of the bed plate of the fixed scroll 1. Accordingly, said elements 6, 6 are pressed by the bottom face 102*a* of the bed plate of the fixed scroll 1 and the bottom face 202*a* of the bed plate of the orbiting scroll 2, respectively, to be uniformly forced into said grooves 5, 5.

And, since a uniform minute gap A is formed between the end face 101*a* of thes piral side plate of the fixed scroll 1 and the bottom face 202*a* of the bed plate of the orbiting scroll 2 as well as the end face 201*a* of the spiral side plate of the orbiting scroll 2 and the bottom face 102*a* of the bed plate of the fixed scroll 1 under the condition that the fixed scroll 1 is fastened together with the lower frame 41 through the upper frame 40 by means of the bolt 42, the elements 6, 6 are forced into the grooves 5, 5 until they are uniformly projected from the grooves 5, 5 by this minute gap A. As a result, the spaced between the end faces 101*a*, 201*a* of the spiral side plates and the bottom faces 202*a*, 102*a* of the bed plates opposite to the end faces 101*a*, 201*a* are substantially compactly filled with said elements 6, 6.

Figure 14:
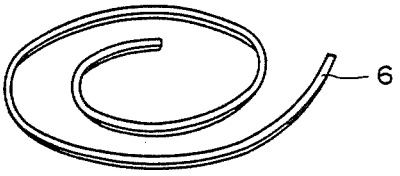
FIG. 14 is a perspective view showing a fine-regulation element and scrolls according to the present invention.
Figure 14:
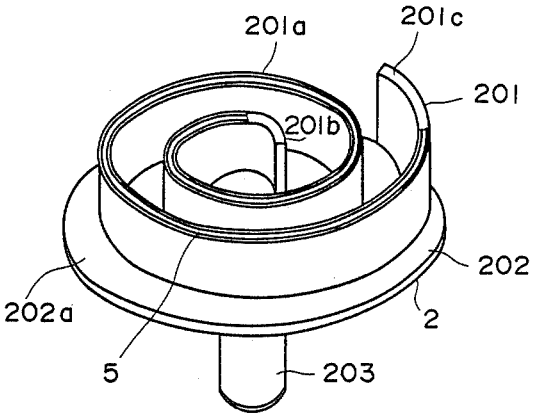

Referring to FIG. 14 which is a perspective view showing a state, in which the element 6 is forced into the groove 5 opening into the end face 201*a* of the spiral side plate 201 of the orbiting scroll 2 and formed along the longitudinal direction of spirals, when assembled, the groove 5 is opened into the end face 201*a* of the spiral side plate 201 and formed almost all over the longitudinal length of spirals except for the inner end portion 201*b* and the outer end portion 201*c* in the spiral direction to force the string-like element 6 vertically into the opening of the groove 5 so as to bury the groove 5. Although an example of the orbiting scroll 2 is herein described, it goes without saying that also the fixed scroll 1 is similarly operated. Also the below description is limited to the orbiting scroll 2.

Figure 15:
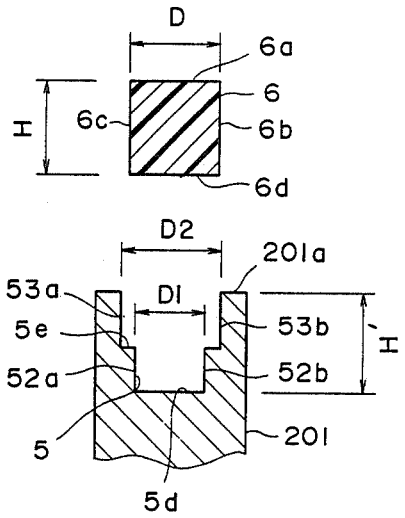
FIGS. 15, 16, 17, 18 are diagrams showing the processes of forcing the fine-regulation element into a groove.

Referring to FIG. 15 which is a local sectional view showing the spiral side plate and the element, the groove 5 is provided with the stepped portion 5*e* formed halfway in the direction of depth thereof, having a two-step construction. The width size D1 of a bottom face 5*d* and side faces 52*a*, 52*b* below the stepped portion 5e is adapted to be smaller than that D2 of the opening portion and side faces 53*a*, 53*b* above the stepped portion 5*e*. Here, a width size D of the element 6 is selected so as to meet the following inequality:

$$D_1 < D < D_2$$

In addition, a thickness size H of the element 6 is selected so as to be substantially equal to or smaller than a depth size H' of the groove 5. Since the width size D of the element 6 is selected so as to meet the inequality D>D1, the element 6 corresponding to the portion below the stepped portion 5*e* of the groove 5 must be formed of elastic or plastic materials. Accordingly, the element 6 is formed of such materials. Above all, tetrafluoroethylene resin (PTFE), having the elasticity, plasticity and flexibility to some degree as well as the self-lubricancy, is most suitable. Also composite materials comprising soft and plastic metals, such as lead and solders, or highly elastic materials, such as rubber, and PTFE may be used.

Figure 16:
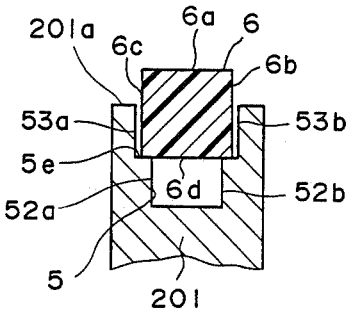

Referring to FIG. 16 which is a local sectional view showing a state in which the element 6 is inserted into the groove 5 as far as the stepped portion 5*e*, in short, a state in which the element 6 is projected over the end face 201*a* of the spiral plate, since the width size D of the element 6 is selected so as to meet the inequality D<D2, the element 6 can be easily inserted into the groove 5 as far as the stepped portion 5*e* of the groove 5, whereby the element 6 be very easily assembled so as to greatly project over the groove 5.

Figure 17:
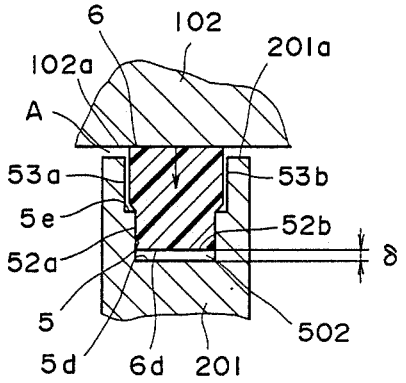
Figure 18:
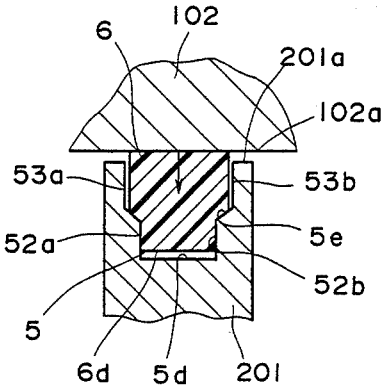

Referring to FIGS. 17, 18 which are local sectional views showing a state, in which such the orbiting scroll 2 is fixed by covering the fixed scroll 1 thereon in an assembly method as shown in FIG. 13, the element 6 projecting from the bottom face 102*a* of the bed plate of the fixed scroll 1 is forced into the groove 5 downward as shown by an arrow and stopped at a position where a preset minute gap A is formed between said bottom face 102*a* of the bed plate and the end face 201*a* of the spiral side plate. At this time, a gap 502 is formed between a lower face 6*d* of the element 6 and the bottom face 5*d* of the groove 5, and the size of the gap 502 in the direction of width is $\delta$; $\delta=(H'+A)-H$.

FIG. 17 shows a case, where the stepped portion 5*e* of the groove 5 is rectangular, while FIG. 18 shows a case where the stepped portion 5*e* is tapered.

Under such an assembled condition, the element 6 is elastically (or plastically) deformed and fixed under the condition that both side faces 6*b*, 6*c* of the element 6 are closely adhered to side faces 52*a*, 52*b* of the groove 5 below the stepped portion 5*e* of the groove 5. In addition, in the case where $D-D_1$ is relatively large, the element 6 formed of, for example, PTFE and the like is not elastically or plastically deformed when forced into the groove 5, whereby the stepped portion 5e shaves the side faces 6*b*, 6*c*. In this case, the shaved burrs are remained in the stepped portion 5*e* without being discharged to the end face 201*a*. In addition, a shearing force acts on the element 6 from the stepped portion 5*e* to prevent the element 6 from moving downward in the axial direction, whereby the element 6 is maintained under the stably fixed condition.

Since the groove 5 is provided with the stepped portion 5*e* in this manner, also the fluctuation of the width sizes D, $D_1$ of the element 6 and the groove 5 when assembled can be absorbed to some degree.

At this time, as to said size $\delta$, even when particularly the central side of spirals is heated to high temperatures during the operation of the compressor, thereby the spiral side plate of central side is thermally expanded in the axial direction to be locally extended and as a result, a size of the minute gap A is locally reduced, whereby the element 6 is locally suppressed by the bottom face of the opposite bed plate, the element 6 is further forced into the groove 5 downward in the axial direction by the bottom face of the opposite bed plate to act as a relief portion for absorbing the change of size due to this thermal expansion.

Figure 19:
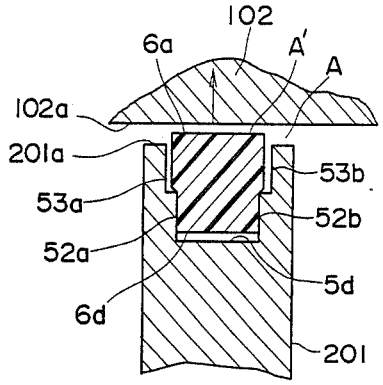
FIG. 19 is a sectional view showing a minute gap between the fine-regulation element and a bed plate when offset.

In the case, where an axial elastic force acts on the element 6, in short, the upper face 6*a* of the element 6 acts an excessive pressing force due to an elastic force on the bottom face 102*a* of the bed plate under the condition as shown in FIGS. 17, 18, it is necessary only to return the bed plate 102 in the direction of the arrow to form the appointed minute gap A' between the upper face 6a of the element 6 and the bottom face 102*a* of the bed plate, as shown in FIG. 19.

Figure 20:
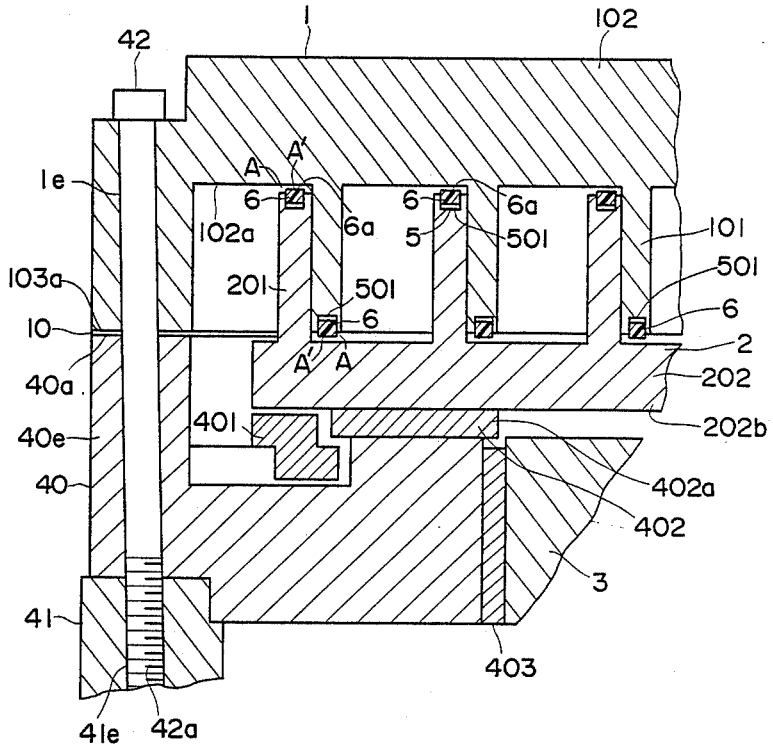
FIG. 20 is a sectional view showing an example of an offset assembling method.

Next, one method of offsetting is shown in FIG. 20. After assembling by the assembly method as shown in FIG. 13, the bolt 42 is removed to remove the fixed scroll 1 from the upper frame 40 and then the bolt 42 is again fastened under the condition that ring shim 10 having a uniform thickness of A' is inserted between the lower face 103*a* of the circumferential wall portion of the fixed scroll 1 and the fitting surface 40*a* of the upper frame 40 to form a uniform minute gap A' between the upper faces 6*a*, 6*b* of the elements 6, 6 of the fixed scroll 1 and the orbiting scroll 2 and the opposite bottom faces 202*a*, 102*a* of the bed plate corresponding thereto.

Next, other constituent members of the compressor as shown in FIG. 7 are in brief described. Referring to FIG. 7, as to the support of a motor for rotating the main shaft 3, a rotor 70 of the motor is fixedly mounted on the main shaft 3 by the shrinkage fit and the like and a stator 71 of the motor is fixedly mounted on the lower frame 41 by means of a bolt and the like with securing a suitable air gap between it and said rotor 70.

A member 8 comprising said constituent members assembled in the above described relation, in short, the assembly comprising the fixed scroll 1, the orbiting scroll 2, the upper frame 40, the lower frame 41, the main shaft 3, the rotor 70, the stator 71 and the like is housed in a shell which is a closed vessel. Here, the shell 9 is divided into three parts - an upper cover 901, a middle cylindrical portion 902 and a bottom cover 903 - the member 8 being fixedly mounted on the middle cylindrical portion 902 on the outside circumferential portion of the lower frame 41 by the shrinkage fit, spot welding and the like, the upper cover 901 and the lower cover 903 being put on both end portions of said middle cylindrical portion 902 so as to cover the upper portion and the lower portion of the middle cylindrical portion 902, respectively, and the upper cover 901 and the lower cover 903 being welded to both end portions of said middle cylindrical portion 902 to hermetically close the shell 9.

A suction pipe 904 opening into an internal space 9*a* of the shell 9 is connected to a circumferential wall of the middle cylindrical portion 902 of the shell 9 by welding, and a discharge pipe 905 is hermetically connected to the central portion of the upper cover 901 of the shell 9, with passing through said central portion and being extended so as to communicate with the discharge port 1a of the fixed scroll 1. The upper cover 901 of the shell 9 is provided with a sealed terminal 906 electrically connected to the stator 71 through a lead wire (not shown) by the welding. A lubricating oil 907 is stored in the bottom portion of the shell 9, the lower end portion of the main shaft 3 being immersed in said lubricating oil 907. In addition, a joint portion of said discharge pipe 905 and the discharge port 1*a* is sealed with an O-ring.

The main shaft 3 is provided with an eccentric oiling port 3*b* passing through from the lower end thereof to the upper end thereof to supply each portion of the bearing with oil.

Figure 1:
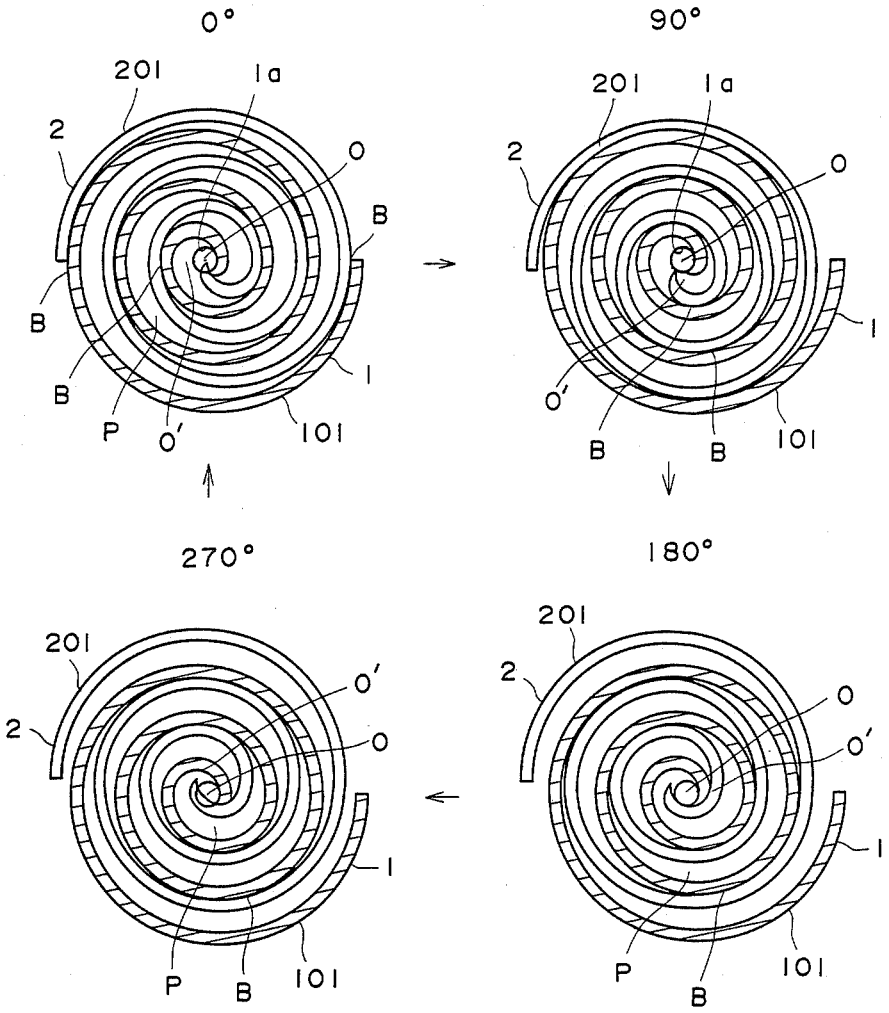
Fig. 1 Prior Art
FIG. 1 is a diagram showing an operation principle of a scroll fluid machine.
Figure 2:
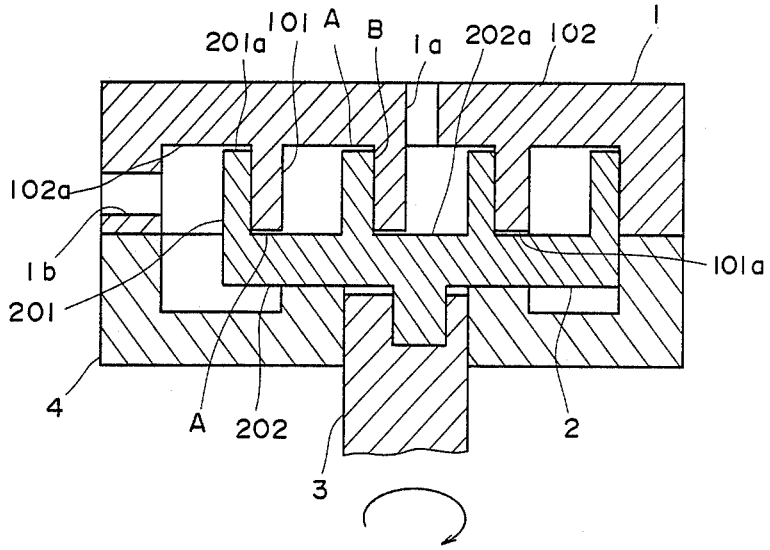
Fig. 2 Prior Art
FIG. 2 is a sectional view showing a conventional scroll fluid machine.
Figure 3:
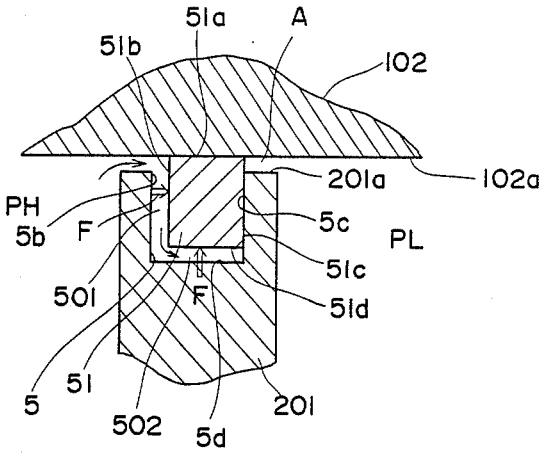
Fig.3 Prior Art
FIG. 3 is a sectional view showing main parts of a conventional gap fine-regulation mechanism.
Figure 4:
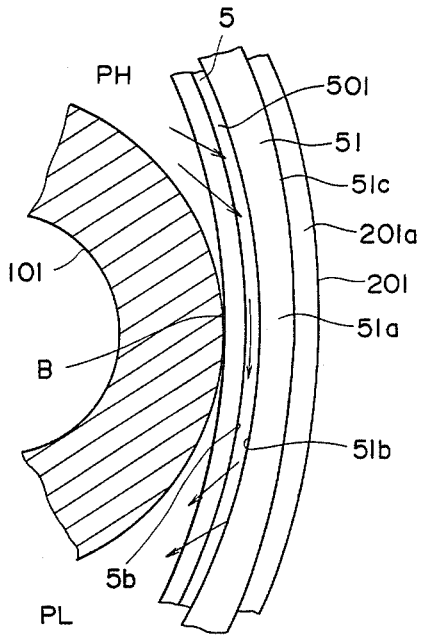
Fig.4 Prior Art
FIG. 4 is a plan view showing a vicinity of a point of contact of both spiral side plates shown in FIG. 3.
Figure 5:
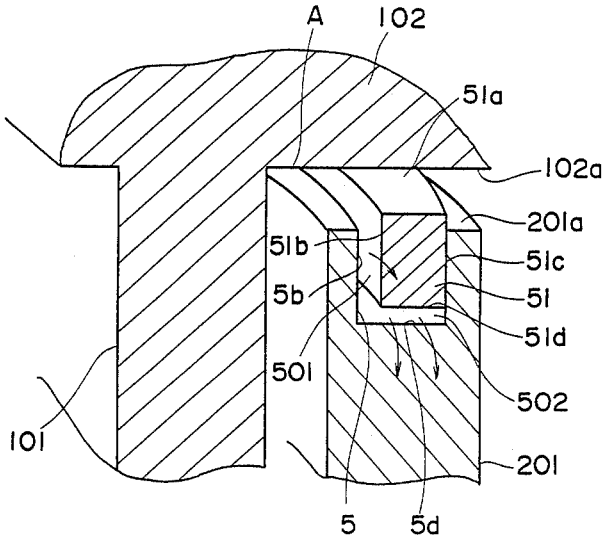
Fig.5 Prior Art
FIG. 5 is a partial perspective view of FIG. 4.
Figure 6:
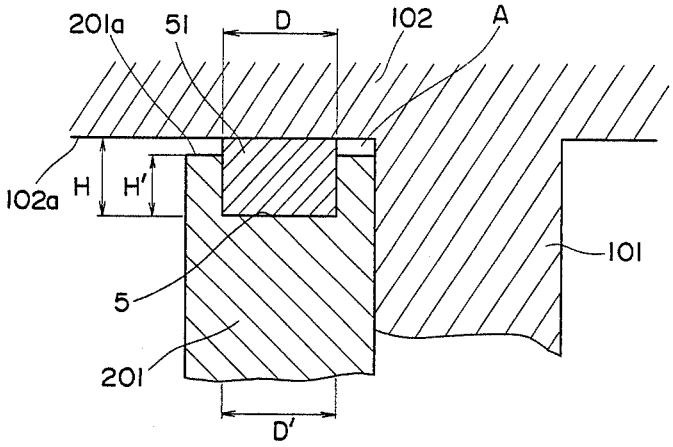
Fig.6 Prior Art
FIG. 6 is a sectional view showing main parts of another example of a conventional leak-preventing mechanism.

Next, the operation of the scroll compressor constructed in the above described manner is described. Upon electrifying the stator 71 through the sealed terminal 906, the rotor 70 generates a torque to rotate together with the main shaft 3. When the main shaft 3 begins to rotate, the rotary power of the main shaft 3 is transmitted to the axis 203 of the orbiting scroll 2 through the eccentric bush 301 put in the eccentric hole 3*a* of the main shaft 3, and the orbiting scroll 2 is revolved with the axis shaft line of the main shaft 3 as a center without rotating on its own axis by being guided by the oldham's coupling 401, whereby the compression as described on the basis of FIG. 1 is carried out in the compression chamber P.

At this time, since the elements 6, 6, forced into the grooves 5, 5 so as to bury the minute gap A between the end faces 101*a*, 201*a* of the spiral side plates 101, 201 and the opposite bottom faces 202*a*, 102*a* of the bed plates 202, 102, are uniformly projected over said end faces 101*a*, 201*a* toward the bottom faces 102*a*, 202*a* under the condition that there is substantially no gap, the compressed fluid is prevented from leaking in the radial direction of spirals, in short, from the compression chamber having a relatively high pressure to the compression chamber having a relatively low pressure, through the minute gap A. In addition, the side faces of the spiral side plates 101, 201 utilize a centrifugal force generated by an eccentric rotational movement of the orbiting scroll 2 to swing the eccentric bush 301 around the axis 203 of the orbiting scroll 2 and make the eccentric quantity of the orbiting scroll 2 relative to the axis shaft line of the main shaft 3 variable, thereby they are engaged with each other at the portion B to prevent the compressed fluid from leaking in the spiral direction through between the side faces of the spiral side plates 101, 201 from the compression chamber having a relatively high pressure to the compression chamber having a relative low pressure. Thus, almost of the leakage in the compression process can be prevented, whereby the operation of the compressor becomes high in compression efficiency.

Next, the flow of the fluid is described. The sucked fluid from an evaporator (not shown) is flown into the internal space 9*a* of the shell 9 through the suction pipe 904 to cool the rotor 70 and the stator 71 and then drawn into the compression chamber P through the suction port 1b after passing through a suction passage (not shown) provided at the outside circumferential portion of the lower frame 41 to be compressed. The compressed fluid is subsequently discharge out of the shell 9 through the discharge port 1*a* and the discharge pipe 905.

Next, an oil supply system is described. The lubricating oil 907 stored in the lower portion of the shell 9 is pumped up to the eccentric hole 3*a* through the eccentric oil supply hole 3*b* by a centrifugal pumping action produced by the rotation of the main shaft 3 to be supplied to the eccentric bush 301. After lubricating the upper thrust bearing 402, the lower thrust bearing 411, the upper main bearing 403, the lower main bearing 412 and the Oldham's coupling 401 through the oil hole 3*e* and the oil groove 301*d* of the main shaft 3, the oil hole 3*d* and the oil groove 301*c* of the eccentric bush 301 and the like, a part of the lubricating oil 907 is sucked into the compression chamber P together with the sucked fluid to seal and lubricate the compression portion and then discharged through the discharge pipe 905 to be returned to the inside of the shell 9 through the suction pipe 904. But, the greater part of the lubricating oil 907 is flown into the lower portion of the shell 9 through oil-return holes (not shown) provided in the upper frame 40 and the lower frame 41.

Next, the operation of the eccentric bush 301 is described. Since the axis 203 of the orbiting scroll 2 is put in the eccentric bush 301 so that the outside circumferential surface of the axis 203 may be slidable against the inside circumferential surface 301*a* of the eccentric bush 301, the center $O_{Bi}$ of the inside circumferential surface 301*a* of the eccentric bush 301 coincides with the swing center, that is to say a center of gravity of the orbiting scroll 2. Accordingly, upon rotating the main shaft 3 in the direction of an arrow W, shown in FIG. 12, a centrifugal force is generated in the direction of an arrow G on a straight line between the center of rotation $O_S$ of the main shaft 3 and the center $O_{Bi}$ of the inside circumferential surface 301*a* of the eccentric bush 301, whereby producing a moment in the direction of an arrow M with the center $O_{Bo}$ of the outside circumferential surface 301b of the eccentric bush 301 as a center. Therefore, in the case where there is a gap between the spiral side plate 101 of the fixed scroll 1 and the spiral side plate 201 of the orbiting scroll 2, the eccentric bush 301 is rotated in the direction of the arrow M with the center $O_{Bo}$ of the outside circumferential surface 301*b* of the eccentric bush 301 as a center so that the orbiting scroll 2 may move until said both spiral side plates 101, 201 are brought into contact with each other.

Figure 21:
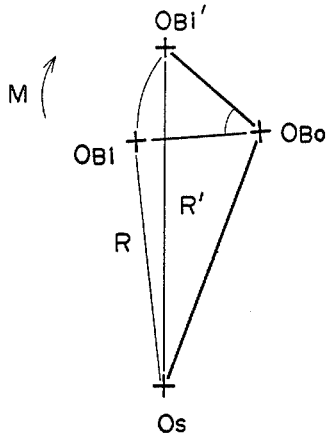
FIG. 21 is a diagram showing a change of the central position of the eccentric bush.

The shift of the central position of the eccentric bush 301 is describing with reference to FIG. 21. The eccentric bush 301 is rotated in the direction of the arrow M with the center $O_{Bo}$ of the outside circumferential surface 301*b* of the eccentric bush 301 as a center while the center $O_{Bi}$ of the inside circumferential surface 301*a* of the eccentric bush 301 is shifted to a point $O_{Bi}'$ where the spiral side plates 101, 201 are brought into contact with each other. That is to say, the revolution radius of the orbiting scroll 2 is changed from $\overline{O_s}\,\overline{O}$HD Bi=R to $\overline{O_s}\,\overline{O_{Bi}}$=R'. On the contrary, in the case where the revolution radius is smaller than R due to the working accuracy, the eccentric bush 301 is rotated in the direction opposite to that of the arrow M.

As above described, the eccentric bush 301 can absorb the fluctuation of the working accuracy, simplify the assembly and prevent the compressed cooling medium gas from leakage through between both spiral side plates 101, 201 in the spiral direction, when compressed, whereby improving the compression efficiency.

Figure 22:
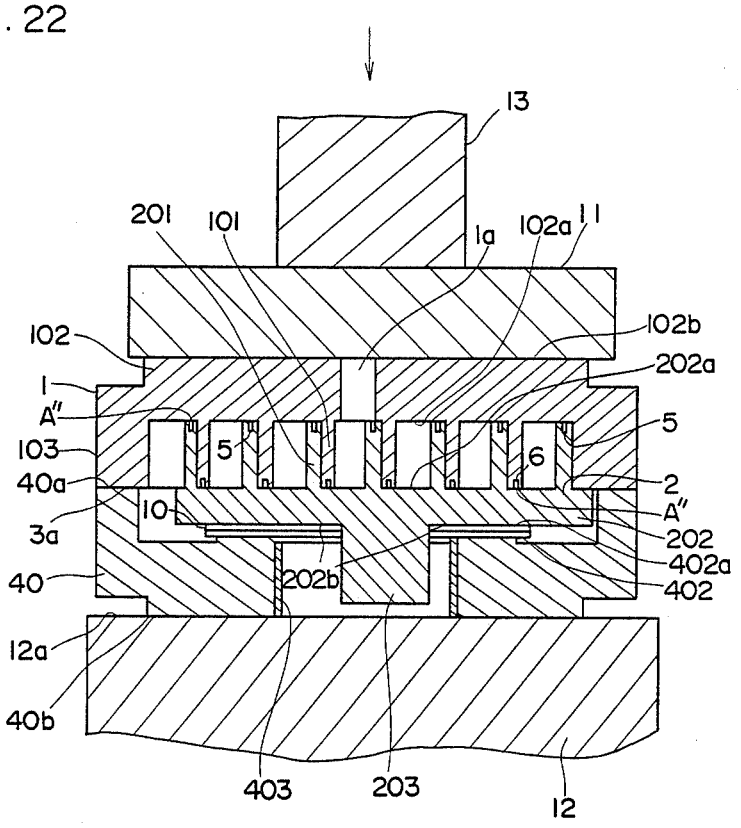
FIG. 22 is a sectional view showing another example of the offset assembling method.

Next, another example of the offset assembling method is described with reference to FIG. 22. The elements 6, 6 are previously projected over the grooves 5, 5 of the end faces 101*a*, 201*a* of the spiral side plates 101, 201 of the fixed scroll 1 and the orbiting scroll 2 by the appointed minute gap A or more. Under such a condition, the upper frame 40 is placed on a bed 12 having a solid plane 12*a* with which the lower face 40*b* thereof is to be brough into contact and ther ing shim 10 having a uniform thickness of A' and almost the same inside diameter and outside diameter as those of said upper thrust bearing 402 is laid on the bearing surface 402*a* of the upper thrust bearing 402 fixedly mounted on the upper face of the upper frame 40. And, the orbiting scroll 2 is placed on the ring shim 10 so that the shim 10 may be put between the back face 202*b* of the bed plate thereof and said upper thrust bearing 402. Thus, the fixed scroll 1 is laid so that the spiral side plate 201 of the orbiting scroll 2 and the spiral side plate 101 of the fixed scroll 1 may be engaged with each other. Then, under such a condition, the fixed scroll 1 is pressed against the plane 12*a* of the bed 12 vertically to it be means of a press arm 13 through a flat plate 11 on the upper face 102*b* of the fixed scroll 1. As a result, the elements 6, 6 of the fixed scroll 1 and the orbiting scroll 2 are stopped under the condition that they are uniformly projected from the grooves 5, 5 by a size A" equal to the subtraction of the thickness A' of the shim 10 from the appointed gap A between the spiral side plates 101, 201 and the opposite bototm faces 202*a*, 102*a* of the bed plates. Subsequently, the shim 10 is removed and the assembly is carried out again by the assembling method as shown in FIG. 13 to form a uniform minute gap A' between the upper faces 6*a*, 6*a* of the elements 6, 6 and the opposite bototm faces 102*a*, 202*a* of the bed plates.

According to the above described two kinds of assembling method, the end face of the spiral side plate of each scroll is provided with the axial gap fine regulation mechanism comprising the element 6 and the groove 5, into which the element 6 is to be forced, so that the condition substantially having no gap through the element 6 or the necessary but minimum minute gap without the fluctuation of working accuracy can be easily set between the end faces of the spiral side plates and the opposite bottom faces of the bed plates, whereby the fluid can be prevented from leaking in the radial direction of spirals when compressed. In addition, since the side faces 6*b*, 6*c* and 52*a*, 53*b*, on which the element 6 and the groove 5 are brought into contact to each other, form substantially no gap therebetween, no fluid is leaked through this portion toward the downstream side of spirals.

Besides, since the element 6 is forced into the groove 5 and fixed therein, the upper face 6*a* of the element 6 does not substantially press against the bottom face of the bed plate. Accordingly, during the normal operation, no abrasion is found on the upper face 6*a* of the element 6. Furthermore, it shows an absence of frictional resistance and the accompanying smooth operation of the eccentric bush 301 that said pressing force does not act upon the bottom face of the bed plate.

In short, the axis shaft line of the orbiting scroll 2 put in the eccentric bush 301 is shifted relatively to the axis shaft line of the main shaft 3 by the swing motion of the eccentric bush 301. And, this swing motion is generated by a centrifugal force and the like of the orbiting scroll 2 itself. However, if an excessive force acts upon the end faces 101*a*, 201*a* of the spiral side plates of the fixed scroll 1 and the orbiting scroll 2, an excessive force is given also to the upper thrust bearing 402 supporting the force of the thrust direction of the orbiting scroll 2 together with the frictional resistance at this portion. As a result, the frictional resistance of these sliding portions acts so that the shift of the orbiting scroll 2 in the direction of pressing the side face of the spiral side plate 201 of the orbiting scroll 2 against the side face of the spiral side plate 101 of the fixed scroll 1 by the swing motion of the eccentric bush 301 due to said centrifugal force may be prevented, whereby the appropriate contact between said side plates is not achieved, so that the leakage through these portion is increased, and the performance is lowered. And, if the load is further increased, the sticking is generated on the upper thrust bearing 402 and the like.

However, according to the present invention, since the upper face 6*a* of the element 6 is not substantially pressed against the bottom faces 102*a*, 202*a* of the bed plates a burden is not imposed on the upper thrust bearing 402, whereby the eccentric bush 301 can be smoothly operated and as a result, the sealing of the side faces of the spiral side plates 101, 201 between themselves can be effectively achieved.

In addition, even when the bottom face of the bed plate is locally pressed against the element 6 due to the reduction of the gap A resulting from the local difference in thermal expansion of the central side of spirals when they are brought into contact under pressure, the local pressing can be absorbed by the local shift of the element 6 into the groove 5, whereby preventing also the sticking trouble and the like.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims, or equivalence of such meets and bounds thereof are therefore intended to be embraced by the claims.

What is claimed is:

1. A scroll fluid machine, in which a plaurlity of chambers are formed between spiral side plates and bed plates by combining a fixed scroll with an orbiting scroll each being formed of the spiral side plate, standing on the bed plate, and a fluid taken in said chambers is compressed or expanded by rotating the orbiting scroll, characterized by being provided with spiral fine regulation elements having the same curvature as each spiral side plate of said both scrolls and grooves formed along end faces of the spiral side plates of said both scrolls, said grooves being provided with a stepped portion formed halfway in the direction of depth thereof, an opened portion of said grooves above the stepped portion having a width larger than that of a bottom portion of said grooves below the stepped portion thereof, said spiral fine regulation elements being forced into said grooves, and wherein means are provided for maintaining said spiral fine regulation elements under a stable fixed condition in said grooves.

2. A scroll fluid machine as set forth in claim 1, in which the grooves have a rectangular section at the opened portion above the stepped portion thereof.

3. A scroll fluid machine as set forth in claim 1, in which the stepped portion formed halfway in the direction of depth of the grooves has a width reduced toward the lower portion of the grooves.

4. A scroll fluid machine as set forth in claim 1, in which said fine regulation elements are made of flexible materials.

5. A scroll fluid machine as set forth in claim 4, in which said flexible materials are tetrafluoroethylene resins.

6. A scroll fluid machine as set forth in claim 4, in which said flexible materials are lead.

7. A scroll fluid machine as set forth in claim 4, in which said flexible materials are solder.

8. A scroll fluid machine as set forth in claim 1, in which the width of the fine regulation elements is larger than the width of the grooves at the bottom portion below the stepped portion of the grooves but smaller than the width of the grooves at the opened portion above the stepped portion.

9. A scroll fluid machine as set forth in claim 8, in which said fine regulation elements are made of flexible materials.

10. A scroll fluid machine as set forth in claim 9, in which said flexible materials are tetrafluoroethylene resins.

11. A scroll fluid machine as set forth in claim 9, in which said flexible materials are lead.

12. A scroll fluid machine as set forth in claim 3, in which the width of the fine regulation elements is larger than the width of the grooves at the bottom portion below the stepped portion of the grooves but smaller than the width of the grooves at the opened portion above the stepped portion.

13. A scroll fluid machine as set forth in claim 12, in which said fine regulation elements are made of flexible materials.

14. A scroll fluid machine as set forth in claim 13, in which said flexible materials are tetrafluoroethylene resins.

15. A scroll fluid machine as set forth in claim 13, in which said flexible materials are lead.

16. A scroll fluid machine as set forth in claim 1, in which the height size of said fine regulation elements is substantially equal to or smaller than the depth size of the grovoes.

17. A scroll fluid machine as set forth inclaim 16, in which said fine regulation elements are made of flexible materials.

18. A scroll fluid machine as set forth in claim 17, in which said flexible materials are tetrafluoroethylene resins.

19. A scroll fluid machine as set forth in claim 17, in which said flexible materials are lead.

* * * * *